US006332250B1

(12) United States Patent
Igaue et al.

(10) Patent No.: US 6,332,250 B1
(45) Date of Patent: Dec. 25, 2001

(54) MECHANICAL FASTENER

(75) Inventors: Takamitsu Igaue; Toshimitsu Baba, both of Kagawa-ken (JP)

(73) Assignee: Uni-Charm Corporation (JP)

( * ) Notice: Subject to any disclaimer, the term of this patent is extended or adjusted under 35 U.S.C. 154(b) by 0 days.

(21) Appl. No.: 09/534,930

(22) Filed: Mar. 24, 2000

(30) Foreign Application Priority Data

Mar. 26, 1999 (JP) ..... 11-083976

(51) Int. Cl.[7] ..... A44B 18/00
(52) U.S. Cl. ..... 24/450; 24/445; 24/451
(58) Field of Search ..... 24/442–452, 30.55, 24/30.5 S, 30.5 P; 428/100

(56) References Cited

U.S. PATENT DOCUMENTS

| | | | | |
|---|---|---|---|---|
| 3,505,155 | | 4/1970 | Balch et al. . | |
| 4,991,362 | | 2/1991 | Heyer et al. . | |
| 5,032,122 | * | 7/1991 | Noel et al. | 24/442 X |
| 5,256,231 | | 10/1993 | Gorman et al. . | |
| 5,326,612 | * | 7/1994 | Goulait | 24/451 X |
| 5,611,791 | * | 3/1997 | Gorman et al. | 24/445 X |
| 5,615,460 | * | 4/1997 | Weirich et al. | 24/451 X |
| 5,699,593 | * | 12/1997 | Jackson | 24/445 |
| 5,763,041 | * | 6/1998 | Leak et al. | 24/447 X |
| 5,997,981 | * | 12/1999 | McCormack et al. | 24/451 X |
| 6,096,667 | * | 8/2000 | Rhode | 24/450 X |
| 6,202,260 | * | 3/2001 | Clune et al. | 24/446 X |

FOREIGN PATENT DOCUMENTS

| | | |
|---|---|---|
| 0 341 993 | 11/1989 | (EP) . |
| A-9-317 | 1/1997 | (JP) . |

OTHER PUBLICATIONS

Copy of European Search Report dated Jul. 17, 2001.

* cited by examiner

*Primary Examiner*—Robert J. Sandy
(74) *Attorney, Agent, or Firm*—Baker & Daniels

(57) ABSTRACT

A mechanical fastener including a loop member includes a base sheet and a plurality of continuous filaments extending substantially parallel one to another on one surface of the base sheet substantially parallel one direction and the filaments are bonded to the base sheet along at least a pair of bonding zones extending transversely of the filaments to form a plurality of loop elements extending between the pair of bonding zones.

6 Claims, 6 Drawing Sheets

MECHANICAL FASTENER

BACKGROUND OF THE INVENTION

This invention relates to a mechanical fastener comprising a loop member for garments such as disposable diapers, incontinence garments and the like.

Japanese Patent Application Disclosure No. 1997-317 describes a female tape comprising a web substantially made of heat-sealable conjugated fibers, the web being formed with sealing zones so that one surface of the web may be densified and the other surface may be formed with a plurality of loop elements.

The female tape described in this Japanese Patent Application Disclosure No. 1997-317 adopts heat-sealable staple fibers of eccentric core-sheath type having a length of 64 mm as the fibers constituting the web. With this construction, the fibers having their ends out of the sealing zones may readily fall off and cause napping in such region. As a result, the hook member may be easily separated from the loop member.

SUMMARY OF THE INVENTION

It is an object of this invention to provide a mechanical fastener comprising a loop member practically free from falling off of fibers and enabling a hook member to be reliably anchored on the loop member.

According to this invention, a fastener is provided which comprises a loop member that is adapted to be releasably engaged with a hook member.

The loop member comprises a base sheet and a plurality of continuous filaments extending on one surface of the base sheet parallel one to another in one direction and the filaments are bonded to the base sheet along at least a pair of bonding zones extending transversely of the filaments to form a plurality of loop elements extending between the pair of bonding zones.

According to one preferred embodiment of this invention, the loop elements are formed by the filaments rounding out above the base sheet between pair of bonding zones.

According to another embodiment of this invention, the loop elements are bonded to the base sheet along at least a pair of bonding zones extending parallel to the filaments.

According to still another embodiment of this invention, the base sheet is divided at least in two sections so that the filaments lying in one of the two sections extend so as to intersect the filaments lying in the other section.

According to further another embodiment of this invention, each of the filaments has a length of 1–30 mm as measured between the bonding zones.

According to an additional embodiment of this invention, the filaments has a fineness of 0.5–60.0 deniers and a basis weight of 20–150 g/m$^2$.

According to still additional embodiment of this invention, each of the bonding zones has a width of 0.5–5.0 mm.

According to further additional embodiment of this invention, the filaments are obtained by deregistering a continuous filament two.

DETAILED DESCRIPTION OF THE PREFERRED EMBODIMENTS

Details of a mechanical fastener comprising a loop member according to this invention will be more fully understood from the description given hereunder with reference to the accompanying drawings.

Figure 1:
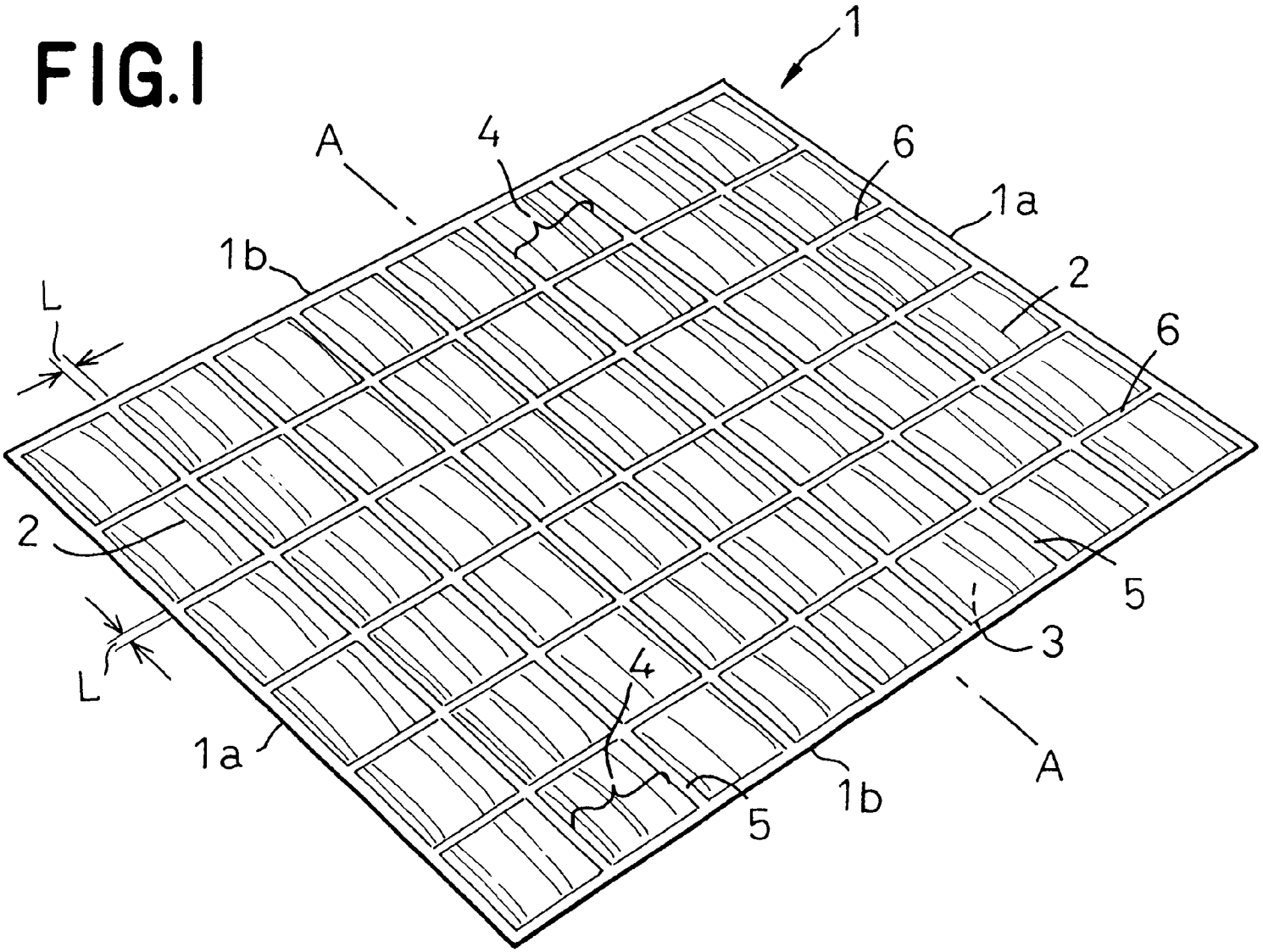
FIG. 1 is a perspective view of an embodiment of a loop member according to this invention.
Figure 2:
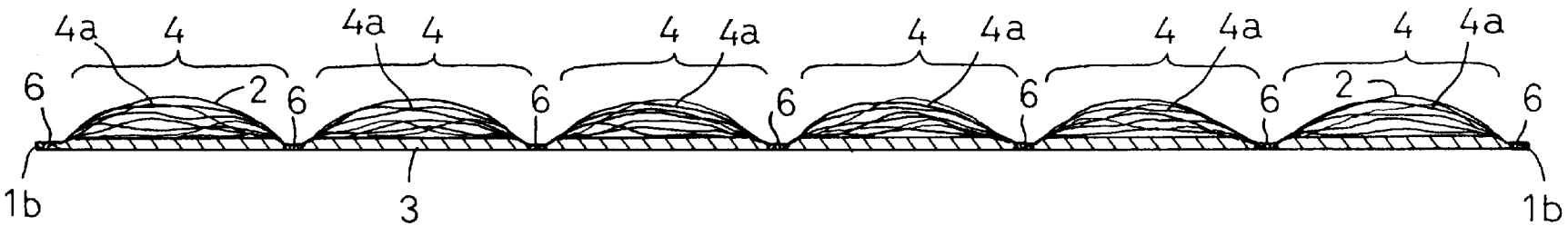
FIG. 2 is a sectional view taken along line A—A in FIG. 1.

FIG. 1 is a perspective view of a loop member 1 and FIG. 2 is a sectional view taken along line A—A in FIG. 1. The loop member 1 is of a rectangular shape defined by transversely opposite side edges 1*a* extending parallel to each other and longitudinally opposite ends 1*b* extending substantially parallel to each other and orthogonally of the side edges 1*a*. The loop member 1 comprises a heat-sealable base sheet 3 and a plurality of heat-sealable continuous filaments 2 arranged on one surface of the base sheet 3 extending one direction parallel one to another.

With this loop member 1, a plurality of bonding zones 5 are arranged at substantially regular intervals between the transversely opposite side edges 1*a* of the loop member 1 substantially parallel to the filaments 2. Similarly, a plurality of bonding zones 6 are arranged at substantially regular intervals between the longitudinally opposite ends 1*b* orthogonally of the filaments 2. Along these bonding zones 5, 6, the filaments 2 are bonded to the base sheet 3 so that these filaments 2 may partially round out above the base sheet 3 between each pair of the adjacent bonding zones 6 and thereby form a plurality of loop elements 4*a*. These bonding zones 5, 6 defines a plurality of loop-crowded regions 4 independent one from another. The filaments 2 partially round out above the base sheet 3 because these filaments 2 are initially layered and bulky and such filaments 2 are bonded to the base sheet 2 partially under pressure.

Bonding of the filaments 2 to the base sheet 3 is performed using supersonic- or heat-sealing technique and along the respective bonding zones 5, 6, the base sheet 3 sealed with the filaments 2 together. As a result, the filaments 2 lose their initial forms and become filmy along the bonding zones 5, 6 while the bonding zones 5 define compressed grooves.

With this loop member 1, when a hook member (not shown) formed with a plurality of hook elements is pressed against the loop member 4, the hook elements are inserted into gaps among the loop elements 4*a* and caught by these loop elements 4*a* so that the hook member may be anchored on the loop member 1. The hook member may be pulled away from the loop member 1 to disengage the respective hook elements from the respective loop elements 4*a* and thereby to separate the hook member from the loop member 1.

There is no concern that one or more filaments might fall off from the loop-crowded regions 4 which might consequently become fluffy unless the filaments are snapped or worn. This is for the reason that none of the filament ends exists in the loop-crowded regions 4.

The filaments 2 may have a length of 1~30 mm as measured between each pair of the adjacent bonding zones 6. The length less than 1 mm would be too short to form the loop elements 4*a*. The length larger than 30 mm would cause the loop elements 4*a* to be readily slacken, resulting in disengagement of the hooks from the loop elements 4*a*.

The filaments 2 may have a length of 1–30 mm as measured between each pair of the adjacent bonding zones 6. The length less than 1 mm would be too short to form the loop elements 4*a*. The length larger than 30 mm would cause the loop elements 4*a* to be readily slacken, resulting in disengagement of the hooks from the loop elements 4*a*.

A basis weight of the filaments 2 may be in a range of 20–150 g/m$^2$. With the basis weight less than 20 g/m$^2$, a density of the filaments 2, i.e., the number of loop elements 4*a* per unit area would be insufficient to ensure a reliable engagement between the loop member 1 and the hook member. With the basis weight larger than 150 g/m$^2$, a density of the filaments 2, i.e., a bulkiness of the loop-crowded regions 4 would be unacceptably increased and the loop elements 4*a* would prevent the hook elements from being sufficiently inserted into the gaps among the loop elements 4*a* to ensure the firm engagement between the loop member 1 and the hook member.

The bonding zones 4 as well as the bonding zones 6 may have a width L of 0.5–5.0 mm. With the width less than 0.5 mm, the filaments 2 would easily get out of the respective bonding zones 5, 6 and it is concerned that the filaments 2 might be peeled off from the base sheet 3 along the bonding zones 5, 6. With the width larger than 5.0 mm, an area ration of the bonding zones 5, 6 to the loop member 1 would be too high to ensure a predetermined area over which the loop-crowded regions 4 should be formed on the loop member 1.

The loop member 1 is not limited to that of the rectangular shape as illustrated but may be of the other shape such as of polygonal, circular or oval shape. It is possible without departing from the scope of this invention to bond the filaments 2 to the base sheet 3 only along the bonding zones 6. It is not essential for this invention that the bonding zones 5 and the bonding zones 5 should extend substantially parallel to and orthogonally of the filaments 2, respectively, and this invention covers also the case in which these bonding zones 5, 6 extend obliquely of the filaments 2.

Figure 3:
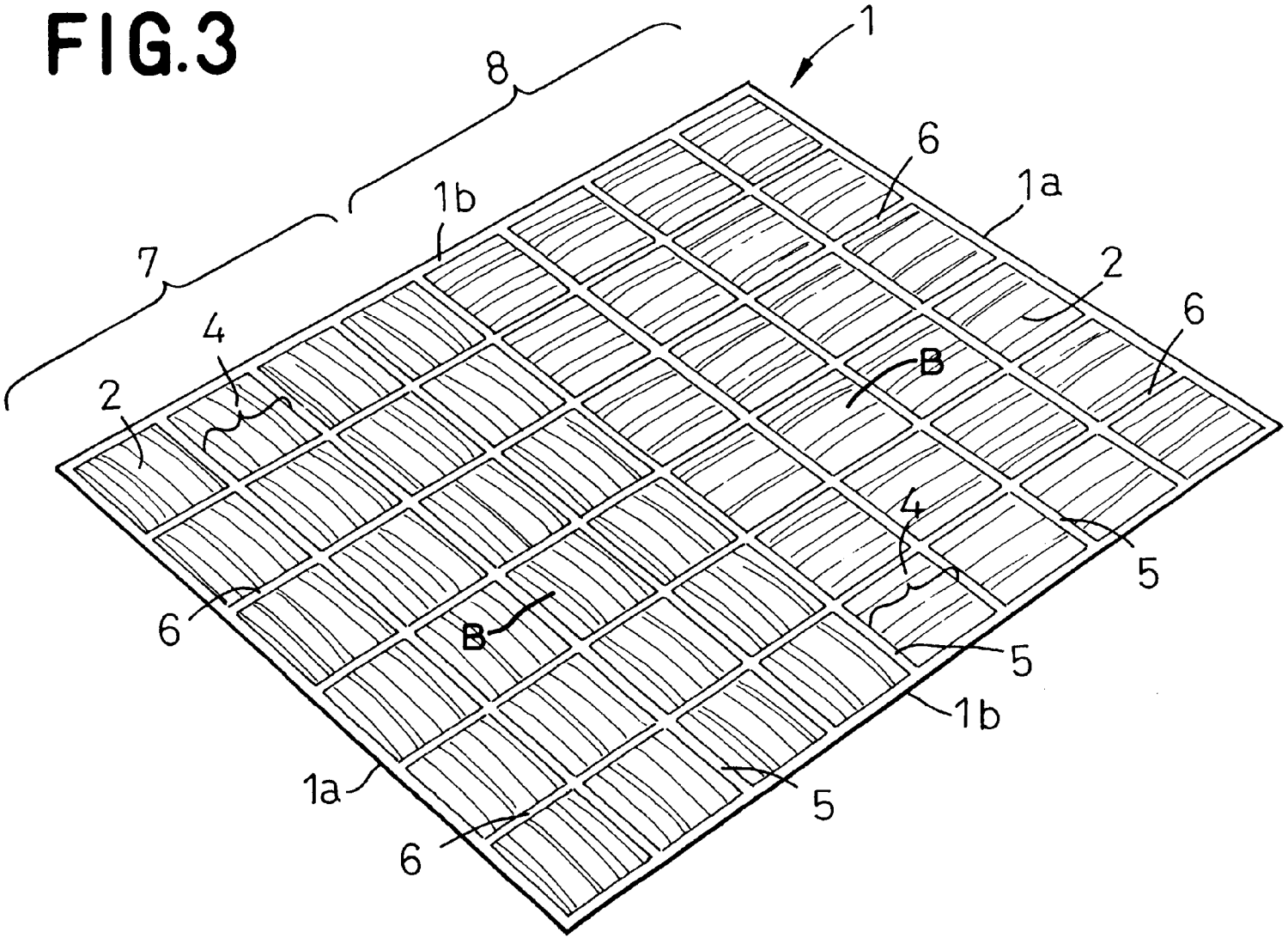
FIG. 3 is a view similar to FIG. 1 showing another embodiment of the loop member.

FIG. 3 is a view similar to FIG. 1 showing another embodiment of the loop member 1. According to this embodiment, an entire area of the loop member 1 is divided in two substantially equal sections 7, 8. In the section 7, a plurality of filaments 2 extend substantially parallel to the bonding zones 5 and, in the section 8, a plurality of filaments 2 extend substantially parallel to the bonding zones 6. In the case of the loop member 1 according to this embodiment, the filaments 2 lying substantially the section 7 extend orthogonally of the filaments 2 lying in the section 8 wherein the filaments 2 are bonded to the base sheet 3 along the bonding zones 5, 6. The particular bonding zones 5 substantially bisecting a dimension between the transversely opposite side edges 1*a* defines a boundary line of these two sections 7, 8.

Figure 4:
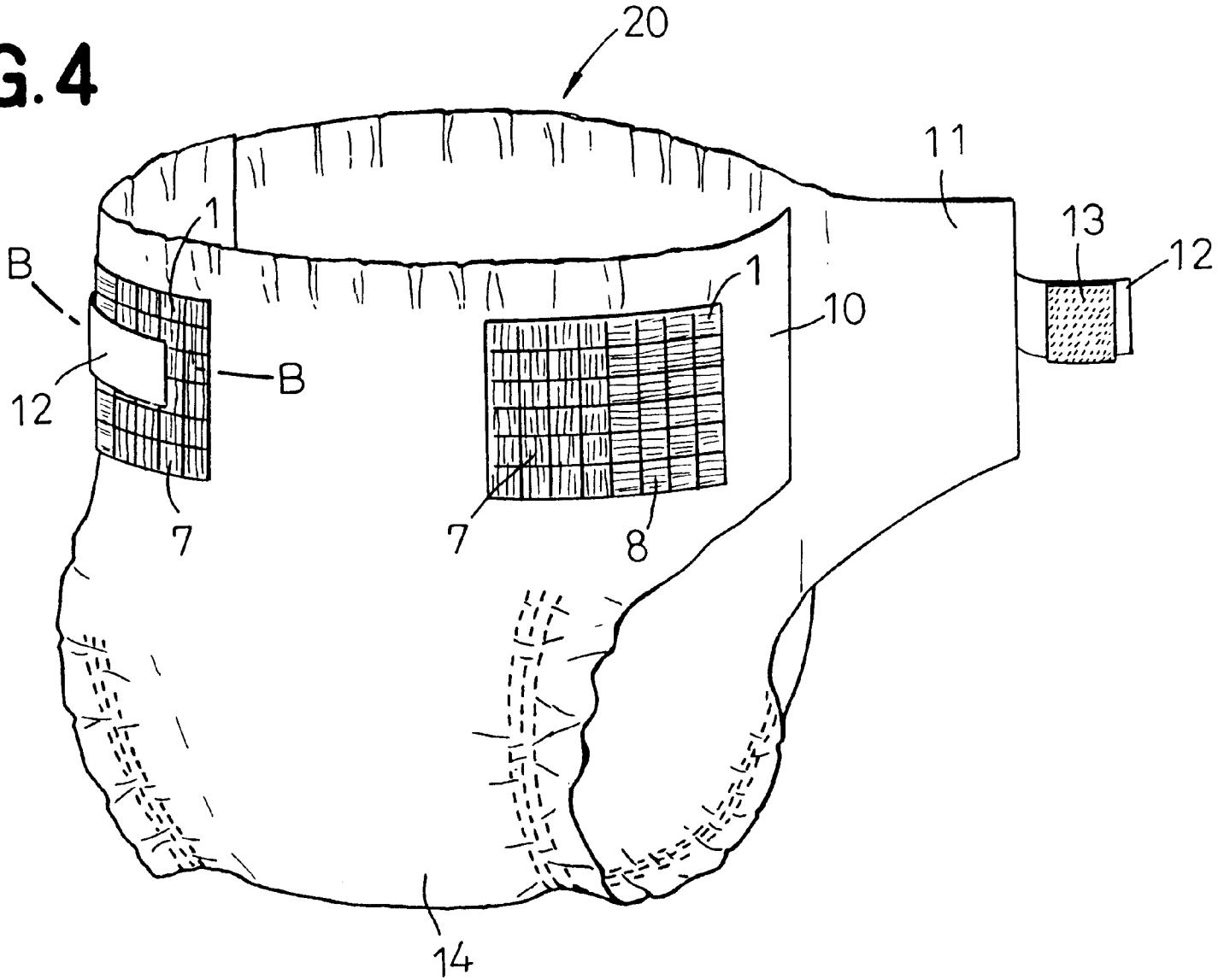
FIG. 4 is a perspective view of a disposable diaper adopting the loop member shown by FIG. 3.
Figure 5:
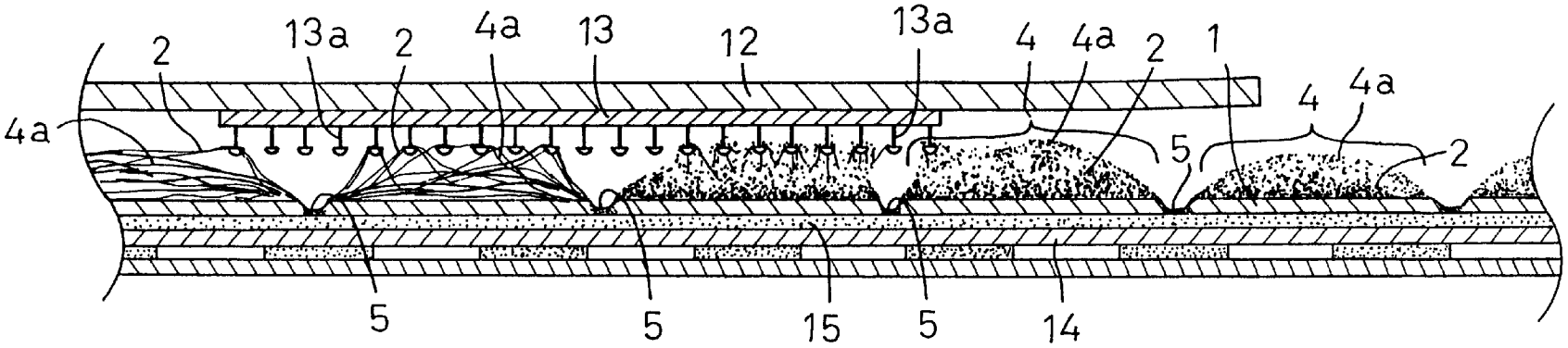
FIG. 5 is a sectional view taken along a line B—B in FIG. 4.
Figure 6:
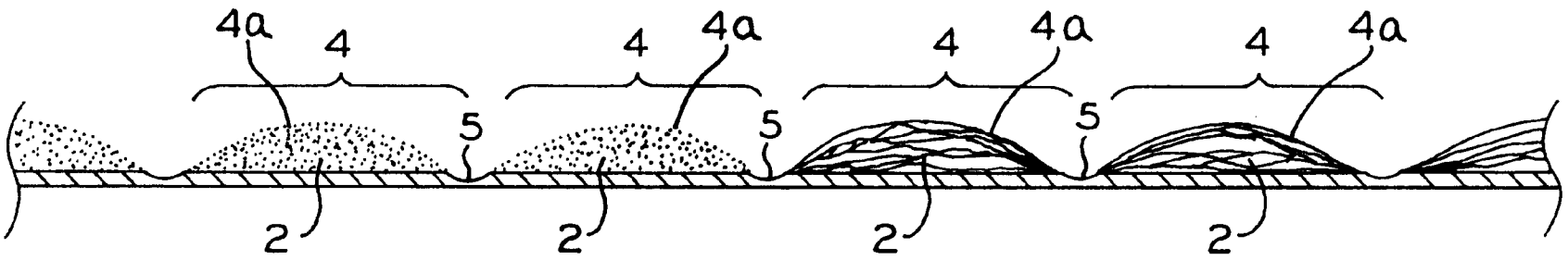
FIG. 6 is a cross-sectional view taken along line B—B in FIG. 3.

FIG. 4 is a perspective view of a disposable diaper 20 adopting the loop member 1 shown in FIG. 3 and FIG. 5 is a sectional view taken along line B—B in FIG. 4. FIG. 4 illustrates two situations in which the loop member 1 and a tape fastener 12 are in engagement with each other and not in engagement with each other. The diaper 20 is provided on transversely opposite side edges of a front waist region 10 with the loop members 1 bonded to a backsheet 14 by means of an adhesive agent 15. On the other hand, the diaper 20 is provided on transversely opposite side edges of a rear waist region 11 with the tape fasteners 12 having their proximal ends bonded to the backsheet 14. The loop members 1 function as pieces of target tape for the associated tape fasteners 12. The respective tape fasteners 12 are provided on their free ends with hook members 13 which are, in turn, formed with a plurality of mushroom-shaped hook elements 13*a*. As seen on the left hand of FIG. 5, these hook elements 13*a* are caught by the loop elements 4*a*.

In the section 7, the filaments 2 extend longitudinally of the diaper 20. Such arrangement is effective to keep the loop member 1 and the hook member 13 in firm engagement with each other even if the diaper 20 put on the wearer's body is placed under tension directed transversely of the diaper 20, depending on movement of the wearer's body.

In the section 8, the filaments 2 extend transversely of the diaper 20. Such an arrangement is effective to keep the loop member 1 and the hook member 13 in firm engagement with each other even if the diaper 20 put on the wearer's body is placed under tension directed longitudinally of the diaper 20, depending on movement of the wearer's body.

It is possible without departing from the scope of this invention to divide the loop member 1 in more than two sections. In this case, the filaments 2 lying in one of each pair of the adjacent sections preferably extend so as to intersect the filaments 2 lying in the other section. For example, it is also possible to modify the arrangement of FIG. 3 so that the filaments 2 lying in one of each pair of the adjacent loop-crowded regions 4 extend so as to intersect the filaments 2 lying in the other loop-crowded region 4.

Stock material for the base sheet 3 may be selected from a group consisting of a nonwoven fabric made of heat-sealable fibers, a heat-sealable plastic film and a laminated sheet obtained from these nonwoven fabric and plastic film. Stock material for the continuous filament 2 may be selected from a group consisting of various kinds of deregistered or opened tow formed by two-layer conjugated fibers of side-by-side type or core-sheath type and multilayer conjugated fibers of multi-core type or archipelago type wherein the conjugated fibers may be of, for example, polyolefine, polyester or polyamide. Each of the loop elements 4*a* formed by the registered tow preferably has one crimp/cm in order that the hook element can be reliably caught by the loop element 4*a*.

When the filaments 2 are bonded to the base sheet 3 using the heat-sealing technique as in the embodiment described herein, the continuous filament 2 preferably comprises conjugated fibers of core-sheath type wherein its core is formed by polypropylene fibers and its sheath is formed by polyethylene fibers having its m.p. lower than that of polypropylene fibers. The filament 2 can be bonded to the base sheet 3 by melting not polypropylene fibers but polyethylene fibers only and it is not concerned that the filaments 2 might be snapped or worn in the bonding zones 6, 7.

Bonding the filaments 2 to the base sheet 3 can be achieved also using a suitable adhesive agent such as hot melt adhesive or glue. When the filaments 2 are bonded to the base sheet 3 using an adhesive agent or glue, the filaments 2 as well as the base sheet 3 may be formed by material other than the heat-sealable material.

The loop member according to this invention enables the hook elements formed on the hook member to be easily caught by the filaments on the loop member and thereby enables the hook member to be reliably anchored on the loop member, since the loop elements are formed by a plurality of continuous filaments. Neither falling off of the filaments from the loop elements nor napping on the loop member occurs as the hook member is peeled off from the loop member.

What is claimed is:

1. A mechanical fastener comprising:

a loop member releasably engaged by a hook member, said loop member comprising:

a heat-sealable base sheet; and a plurality of continuous heat-sealable filaments formed from a deregistered continuous tow filament, said plurality of continuous filaments extending on one surface of said base sheet substantially parallel to one another in one direction and being bonded to said base sheet by a plurality of first and second bonding zones, said first bonding zones being arranged at substantially regular intervals between transversely opposite side edges of said loop member substantially parallel to said continuous filaments and said second bonding zones are arranged at substantially regular intervals between longitudinally opposite side edges of said loop member orthogonally to said first bonding zones to define a plurality of loop-crowded regions.

2. The mechanical fastener according to claim 1, wherein said plurality of loop elements are formed by the rounding out of said plurality of filaments above zones of the base sheet which are defined by said plurality of loop-crowded regions.

3. The mechanical fastener according to claim 1, wherein said plurality of loop elements are bonded to said base sheet along at least a pair of bonding zones extending substantially parallel to said plurality of filaments.

4. The mechanical fastener according to claim 1, wherein said base sheet is divided at least into two sections so that a plurality of filaments lying in one of said two sections extend so as to intersect a plurality of filaments lying in another of said two sections.

5. The mechanical fastener according to claim 1, wherein each of said plurality of filaments has a length of 0.5–30 mm measured between each pair of said second bonding zones.

6. The mechanical fastener according to claim 1, wherein said plurality of filaments has a fineness of 0.5–60.0 deners and a basis weight of 20–150 g/m$^2$.

* * * * *